US011117337B2

(12) United States Patent
Suva et al.

(10) Patent No.: US 11,117,337 B2
(45) Date of Patent: Sep. 14, 2021

(54) RECIPROCATING PRESS

(71) Applicant: Promess, Inc., Brighton, MI (US)

(72) Inventors: Neil Suva, Farmington Hills, MI (US); Matthew R. Rall, Howell, MI (US); Andrew H. Joseph, Milford, MI (US); Glenn W. Nausley, Jr., Howell, MI (US)

(73) Assignee: Promess, Inc., Brighton, MI (US)

( * ) Notice: Subject to any disclaimer, the term of this patent is extended or adjusted under 35 U.S.C. 154(b) by 322 days.

(21) Appl. No.: 16/354,621

(22) Filed: Mar. 15, 2019

(65) Prior Publication Data

US 2020/0290302 A1 Sep. 17, 2020

(51) Int. Cl.
*B30B 1/26* (2006.01)
*B30B 15/00* (2006.01)

(52) U.S. Cl.
CPC ..... *B30B 1/263* (2013.01); *B30B 1/266* (2013.01); *B30B 15/0094* (2013.01)

(58) Field of Classification Search
CPC .... B30B 1/06; B30B 1/14; B30B 1/26; B30B 1/263; B30B 1/266; B30B 15/281
USPC ..... 72/452.5
See application file for complete search history.

(56) References Cited

U.S. PATENT DOCUMENTS

| | | | | |
|---|---|---|---|---|
| 5,047,618 | A | 9/1991 | Kobayashi | |
| 8,997,544 | B2 | 4/2015 | Abt et al. | |
| 9,868,264 | B2 | 1/2018 | Fahrenbach | |
| 2001/0032551 | A1* | 10/2001 | Horie | B30B 1/263 100/102 |
| 2008/0127839 | A1* | 6/2008 | Fahrenbach | B30B 15/0041 100/214 |
| 2011/0132209 | A1 | 6/2011 | Senda et al. | |
| 2011/0214473 | A1* | 9/2011 | Abt | B30B 1/263 72/347 |
| 2017/0108096 | A1 | 4/2017 | Martin et al. | |
| 2020/0047442 | A1* | 2/2020 | Law | B30B 15/0094 |

FOREIGN PATENT DOCUMENTS

| | | | | |
|---|---|---|---|---|
| DE | 102015224999 | A1 | 6/2017 | |
| EP | 3505907 | A1 * | 7/2019 | F16H 21/20 |
| JP | 2004090036 | A * | 3/2004 | B30B 1/263 |
| RU | 2114349 | C1 * | 6/1998 | |

* cited by examiner

*Primary Examiner* — Edward T Tolan
*Assistant Examiner* — Jared O Brown
(74) *Attorney, Agent, or Firm* — Quinn IP Law

(57) ABSTRACT

A reciprocating press for acting on a workpiece is described, and includes an eccentric shaft rotatably disposed in a rotatable eccentric sleeve, and a crank-slider mechanism coupled to the eccentric shaft. Rotations of the eccentric shaft and the rotatable eccentric sleeve are independently controllable to dynamically vary a stroke length of the crank-slider mechanism.

27 Claims, 7 Drawing Sheets

RECIPROCATING PRESS

TECHNICAL FIELD

The concepts described herein related to mechanical actuators, including devices employed to provide a continuous reciprocating press for assembly and testing.

INTRODUCTION

A reciprocating press is one form of a mechanical actuator that may be employed in a manufacturing environment to execute one or more manufacturing or assembly steps on a workpiece, including, e.g., high-speed reciprocating press-fit assembly, punching, or drawing. A reciprocating press actuator may also be employed in a testing environment to perform repetitive cycling, such as for fatigue testing.

One issue related to use of a reciprocating press actuator in a manufacturing or testing environment includes a capability to adjust a stroke length of the portion of the actuator that interfaces with the workpiece. Presently, stroke length adjustment is accomplished by a machine operator when the actuator is not in-use in many circumstances, resulting in downtime and associated loss of productivity.

Other issues related to manufacturing or assembly steps executed by a reciprocating press include a capability to operate at high rates, e.g., greater than 1 Hz, and provide a consistent, uniform exerted force or pressure from the reciprocating press onto the workpiece, which may affect workpiece quality, part-to-part variability and tooling wear. Such information may also be useful in determining tooling maintenance schedules.

SUMMARY

A reciprocating press for acting on a workpiece is described, and includes an eccentric shaft rotatably disposed in a rotatable eccentric sleeve, and a crank-slider mechanism coupled to the eccentric shaft. Rotations of the eccentric shaft and the rotatable eccentric sleeve are independently controllable to dynamically vary a stroke length of the crank-slider mechanism.

An aspect of the disclosure includes the crank-slider mechanism including a piston coupled to a connecting rod, the eccentric shaft including a crankpin, and the crankpin being coupled to the connecting rod.

Another aspect of the disclosure includes the rotations of the eccentric shaft and the rotatable eccentric sleeve being independently controllable to achieve a desired motion profile for the piston of the crank-slider mechanism.

Another aspect of the disclosure includes rotations of the eccentric shaft and the rotatable eccentric sleeve being independently controllable to dynamically vary a stroke length of the piston of the crank-slider mechanism.

Another aspect of the disclosure includes the stroke length of the piston of the crank-slider mechanism being infinitely variable between a minimum stroke and a maximum stroke.

Another aspect of the disclosure includes the piston of the crank-slider mechanism being arranged to reciprocate by the rotations of the eccentric shaft and the rotatable eccentric sleeve.

Another aspect of the disclosure includes a load sensor being arranged to monitor load exerted by the piston on the workpiece.

Another aspect of the disclosure includes the rotations of the eccentric shaft and the rotatable eccentric sleeve being independently controllable to dynamically vary the stroke length of the crank-slider mechanism, including an angular velocity of the eccentric shaft being equivalent to an angular velocity of the rotatable eccentric sleeve, wherein the stroke length of the crank-slider mechanism is dynamically varied by adjusting a phase between an angular position of the eccentric shaft and an angular position of the rotatable eccentric sleeve.

Another aspect of the disclosure includes a first electric motor coupled to the eccentric shaft and a second electric motor coupled to the rotatable eccentric sleeve, wherein the first and second electric motors are independently and dynamically controllable to control the rotations of the eccentric shaft and the rotatable eccentric sleeve to vary the stroke length of the crank-slider mechanism.

Another aspect of the disclosure includes a harmonic gearset, wherein the eccentric shaft is coupled to the first motor via the harmonic gearset.

Another aspect of the disclosure includes an offset belt driver, wherein the rotatable eccentric sleeve is coupled to the second motor via the offset belt driver.

Another aspect of the disclosure includes the eccentric shaft including an upper portion, a middle portion and a lower portion, wherein the upper portion of the eccentric shaft is coupled to the first motor via an offset coupler and a harmonic gearset, wherein the middle portion of the eccentric shaft is arranged to rotate within the inner portion of the rotatable eccentric sleeve, and wherein a crankpin is disposed on the lower portion.

Another aspect of the disclosure includes the offset coupler being a Schmidt coupler.

Another aspect of the disclosure includes the first electric motor including a rotor that defines a first axis, wherein the eccentric shaft defines a second axis, and wherein the first axis is parallel to and offset from the second axis.

Another aspect of the disclosure includes the rotations of the eccentric shaft and the rotatable eccentric sleeve being independently controllable to dynamically vary the stroke length of the crank-slider mechanism, including an angular velocity of the eccentric shaft being variable relative to an angular velocity of the rotatable eccentric sleeve, wherein the stroke length of the crank-slider mechanism is dynamically varied by adjusting a phase between an angular position of the eccentric shaft and an angular position of the rotatable eccentric sleeve in response to a desired motion profile.

Another aspect of the disclosure includes a first electric motor coupled to the eccentric shaft and a second electric motor coupled to the rotatable eccentric sleeve, wherein the first and second electric motors are independently and dynamically controllable to control the rotations of the eccentric shaft and the rotatable eccentric sleeve to control the stroke length of the crank-slider mechanism.

Another aspect of the disclosure includes a controller in communication with the first and second electric motors, wherein the controller controls the first and second electric motors to control the rotations of the eccentric shaft and the rotatable eccentric sleeve to control the stroke length of the crank-slider mechanism.

Another aspect of the disclosure includes a dynamic counterbalance element disposed on the rotatable eccentric sleeve.

Another aspect of the disclosure includes a device for exerting a reciprocating force on a workpiece that includes an eccentric shaft, an eccentric sleeve, a crank-slider mechanism, a first electric motor, a second electric motor, a housing portion, a base portion, and a mount portion. The eccentric shaft is rotatably disposed within the rotatable eccentric sleeve, and the rotatable eccentric sleeve being rotatably disposed in the housing portion. The eccentric shaft includes a crankpin, and is rotatably coupled to the first motor. The rotatable eccentric sleeve is rotatably coupled to the second motor. The crank-slider mechanism includes a piston and a connecting rod, wherein the piston of the crank-slider mechanism is disposed in and translatable in the mount portion and the crankpin is disposed in the base portion, and the connecting rod of the crank-slider mechanism is coupled to the crankpin. The piston is disposed to act upon a workpiece that is disposed adjacent to the mount portion, and is arranged to reciprocate in the mount portion by rotations of the eccentric shaft and the rotatable eccentric sleeve. The first and second electric motors are independently controllable to control rotations of the eccentric shaft and the rotatable eccentric sleeve to dynamically vary a stroke length of the reciprocating piston.

Another aspect of the disclosure includes a controller operatively coupled to the first and second electric motors, wherein the first and second electric motors are controllable by the controller to control the piston at a dynamically variable stroke length to act upon the workpiece via the eccentric shaft and the rotatable eccentric sleeve.

Another aspect of the disclosure includes the first and second electric motors being controllable by the controller to control the piston at a dynamically variable stroke length to act upon the workpiece via the eccentric shaft and the rotatable eccentric sleeve comprises the first and second electric motors being controllable by the controller to control the piston responsive to a desired motion profile.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

Figure 1:
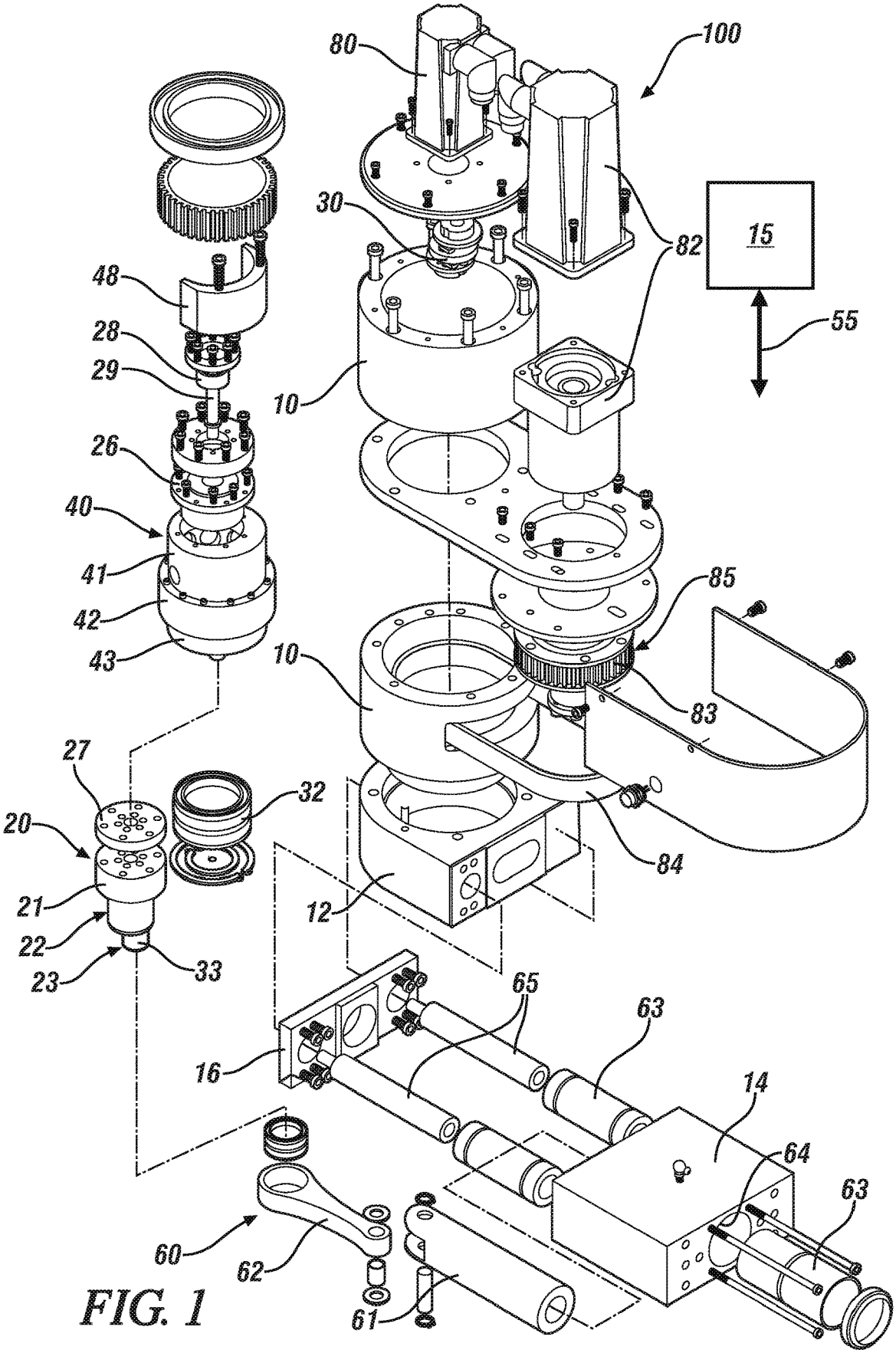
FIG. 1 schematically illustrates an exploded isometric view of a reciprocating press, in accordance with the disclosure.

The appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid obscuring the disclosure. For purposes of convenience and clarity only, directional terms such as vertical, horizontal, top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein. The disclosure may further include hardware that is not illustrated in the Figures, but is nonetheless contemplated herein. Like numerals refer to like elements in the various drawings.

The concepts described herein include a reciprocating press 100 for acting on a workpiece 99, as detailed with reference to FIGS. 1, 2, 3 and 4. The reciprocating press 100 includes an eccentric shaft 20 that is rotatably disposed in a rotatable eccentric sleeve 40, and a crank-slider mechanism that is coupled to the eccentric shaft 20. The reciprocating press 100 is arranged such that rotation of the eccentric shaft 20 is independently controllable from rotation of the rotatable eccentric sleeve 40. The eccentric shaft 20 includes a cantilevered crankpin 33 that is coupled to a connecting rod 62 of the crank-slider mechanism 60, and a piston 61 of the crank-slider mechanism 60 is advantageously positioned to linearly act upon the workpiece 99 in a reciprocating manner by controlling rotations of the eccentric shaft 20 and the rotatable eccentric sleeve 40 to control the crank-slider mechanism 60. Because the rotations of the eccentric shaft 20 and the rotatable eccentric sleeve 40 are independently controllable, the crank-slider mechanism 60 can be controlled so that the piston 61 is able to achieve a dynamically variable stroke length S (shown with reference to FIG. 8) in relation to the workpiece 99 (shown with reference to FIG. 2).

The reciprocating press 100 includes a housing portion 10, a base portion 12, and a mount portion 14 that are advantageously arranged to accommodate the eccentric shaft 20, the rotatable eccentric sleeve 40, and the crank-slider mechanism 60. A first electric motor 80 rotatably couples to the eccentric shaft 20 and a second electric motor 82 rotatably couples to the rotatable eccentric sleeve 40. A load cell 16 is interposed between the base portion 12 and the mount portion 14. A controller 15 is in communication with the first and second electric motors 80, 82 and the load cell 16. The eccentric shaft 20 and the rotatable eccentric sleeve 40 are vertically oriented as shown, and the crank-slider mechanism 60 is horizontally oriented as shown.

The eccentric shaft 20 includes an upper portion 21, a middle portion 22 and a lower portion 23. The upper portion 21 of the eccentric shaft 20 is a disc-shaped element that has a circular cross-section that defines a first axis 24. The upper portion 21 provides a mounting area on which a harmonic gearset 26 is mounted via an intervening harmonic interface 27. An input member 29 is attached to the input of the harmonic gearset 26. The harmonic gearset 26 includes, in one embodiment, a wave generator, an externally toothed flex ring and an internally toothed gear ring that interact to transmit torque while permitting elastic deformation. In one embodiment, the externally toothed flex ring may have a non-circular shape when in an unloaded state.

The input member 29 is coupled to a first end of an offset torque coupler 30, and a second end of the offset torque coupler 30 is coupled to a rotor of the first electric motor 80. The rotor of the first electric motor 80 defines a third axis 31, and the third axis 31 is offset from the first axis 24. In one embodiment, the offset torque coupler 30 is a Schmidt-Kupplung® coupling that is available from Schmidt-Kupplung GmbH, Wolfenbuttel, Germany (hereafter "Schmidt coupler") (as shown). Alternatively, the offset torque coupler 30 may be a gear coupler, a chain/sprocket coupler, or another suitable coupler. An outer diameter of the upper portion 21 may be slightly smaller than a corresponding inside diameter of the rotatable eccentric sleeve 40. The middle portion 22 of the eccentric shaft 20 has a circular cross-section that is concentric to the first axis 24. The outer surface of the middle portion 22 is arranged to accommodate a concentric bearing 32. An outer diameter of the concentric bearing 32 is slightly larger than the corresponding inner diameter of an inner cylindrical portion 41 of the rotatable eccentric sleeve 40, such that the concentric bearing 32 interferingly fits therein when the eccentric shaft 20 and concentric bearing 32 are inserted into the rotatable eccentric sleeve 40, e.g., by a reciprocating press-fit operation. The lower portion 23 projects below the main housing 10 into a cavity in the base 12, and includes the crankpin 33, which is a cylindrical element having a centerline 25 that is offset from and thus eccentric to the first axis 24. This arrangement facilitates rotation of the eccentric shaft 20 within the rotatable eccentric sleeve 40, whereby the first electric motor 80 can be controlled to rotate the crankpin 33. The rotation of the crankpin 33 actuates the crank-slider mechanism 60.

The rotatable eccentric sleeve 40 is arranged as a cylindrical device that defines an inner cylindrical portion 41 that is concentric to the first axis 24, and is eccentric to a centerline 49 that is defined by an outer diameter of the rotatable eccentric sleeve 40. The rotatable eccentric sleeve 40 includes an upper portion 42, a middle portion 43 and a lower portion 44. The upper portion 42 includes a plurality of voids 46 formed in the wall of the rotatable eccentric sleeve 40. The upper portion 42 also includes an upper surface 47 on which a counterweight 48 is attached. The plurality of voids 46 and the counterweight 48 are designed to reduce vibration and thus dynamically balance the reciprocating press 100 during operation. Details of the quantity, size and placement of the voids, and the size, mass and placement of the counterweight 48 are application-specific. The middle portion 43 includes a circumferential toothed section 45 that includes a plurality of teeth that interact with a drive belt 84. The second electric motor 82 includes a rotor having a shaft that is coupled to a sprocket 83, which also interacts with the drive belt 84. The circumferential toothed section 45 of the middle portion 43 of the rotatable eccentric sleeve 40, the drive belt 84, and the sprocket 83 of the second electric motor 82 form an offset drive mechanism 85.

The rotatable eccentric sleeve 40 is rotatably mounted within the housing 10. This includes the upper portion 42 being mounted into the housing 10 via bearing 51 and the lower portion 44 being mounted into the housing 10 via bearing 52, thus facilitating rotation of the rotatable eccentric sleeve 40 in the housing 10. The offset drive mechanism 85 can be controlled to control rotation of the rotatable eccentric sleeve 40 in the housing 10.

The housing 10 is rigidly assembled onto the base 12 employing fasteners. The mount portion 14 is assembled onto the base 12 employing rails 65 that couple to the mount portion 14 and the base 12. The mount portion 14 includes a horizontal-oriented, cylindrically-shaped aperture 64 through which the piston 61 of the crank-slider mechanism 60 reciprocates. In one embodiment, a bushing 63 is interposed between the aperture 64 and the piston 61.

Figure 2:
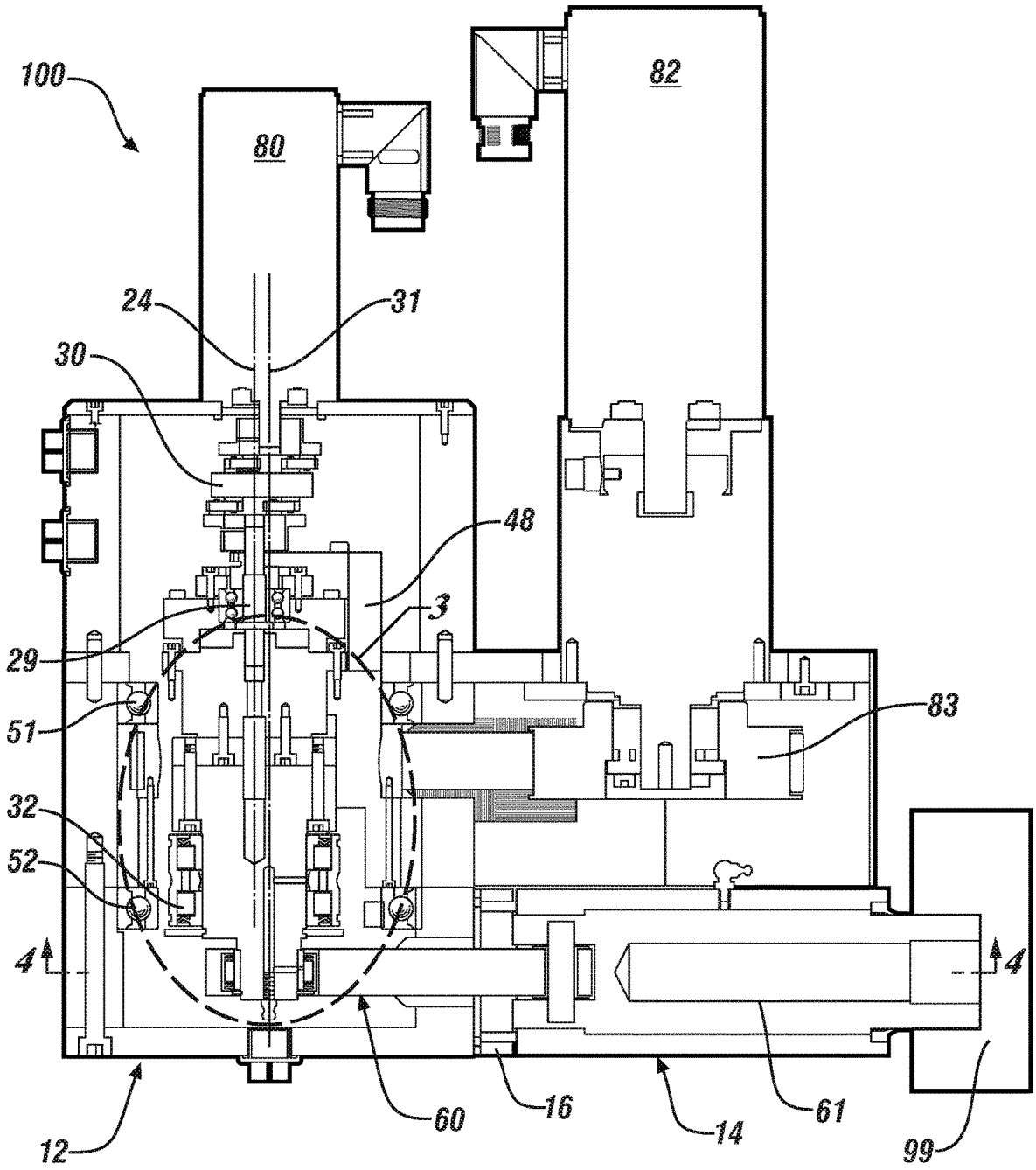
FIG. 2 schematically illustrates a cutaway side view of a reciprocating press, in accordance with the disclosure.
Figure 3:
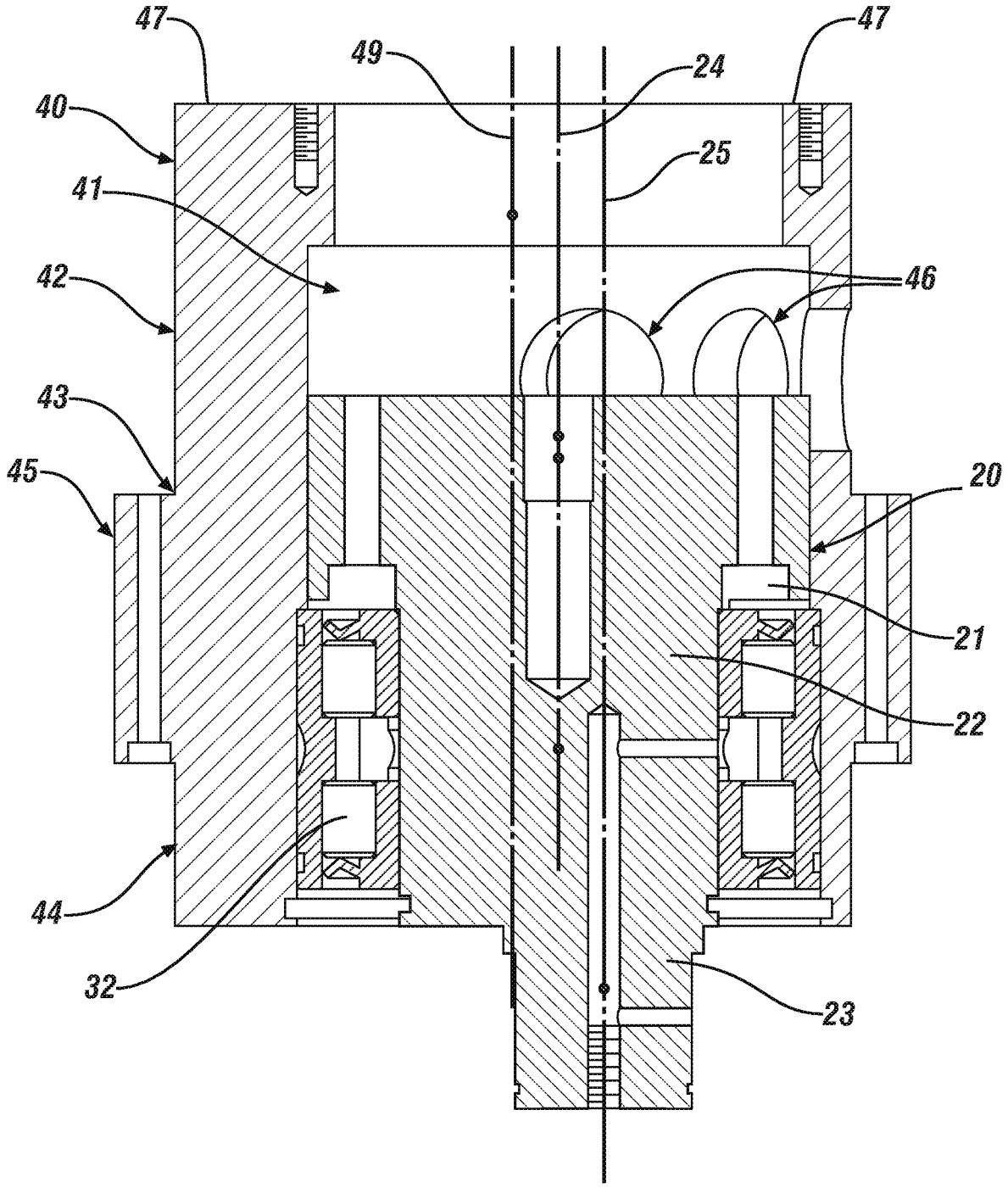
FIG. 3 schematically illustrates a cutaway side view of a portion of a reciprocating press, including an eccentric shaft disposed in an eccentric sleeve, in accordance with the disclosure.
Figure 4:
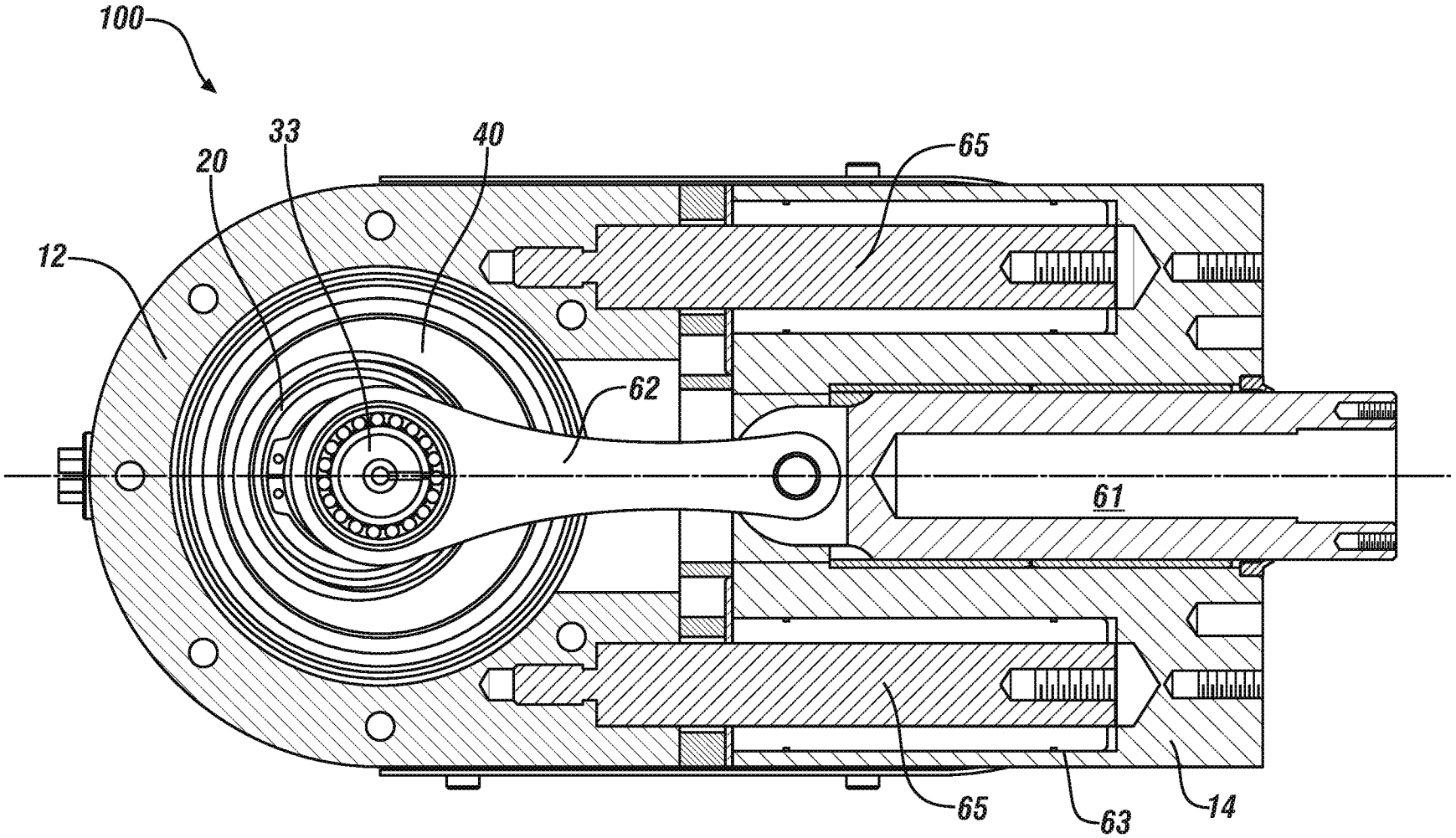
FIG. 4 schematically illustrates a cutaway bottom view of a reciprocating press, in accordance with the disclosure.

As shown with reference to FIG. 2, the load cell 16 is interposed between the base portion 12 and the mount portion 14 and arranged to monitor magnitude of force exerted by the piston 61 of the crank-slider mechanism 60 on the proximal workpiece 99. In one embodiment, the load cell 16 is a strain gage load cell. Results associated with the magnitude of force exerted by the piston 61 as measured by the load cell 16 may be captured and employed to verify assembly quality parameters, verify test procedure parameters are being achieved, detect worn tooling, evaluate occurrence of trends, and adjust cycle motion when necessary.

The first and second electric motors 80, 82 are single-phase or multi-phase permanent magnet electric motors that employ absolute encoders to monitor and control angular position, angular speed, and direction of rotation of the respective shafts, in one embodiment. One skilled in the art appreciates that other electric motor configurations and associated position measurement devices may instead be employed.

The controller 15 electrically communicates with the first and second electric motors 80, 82 to control angular position, angular speed, and direction of rotation. In one embodiment, the controller 15 controls the angular speeds so that the eccentric shaft 20 and the rotatable eccentric sleeve 40 move in tandem, resulting in sinusoidal motion of the piston 61. Furthermore, the controller 15 controls the angular positions to control a phase angle between the eccentric shaft 20 and the rotatable eccentric sleeve 40 to vary a stroke length of the piston 61 of the crank-slider mechanism 60, including dynamically varying the stroke length during operation. This operation permits development and use of arbitrary cyclical motion profiles by independently controlling the angular positions and angular speeds of the first and second electric motors 80, 82.

Figure 5:
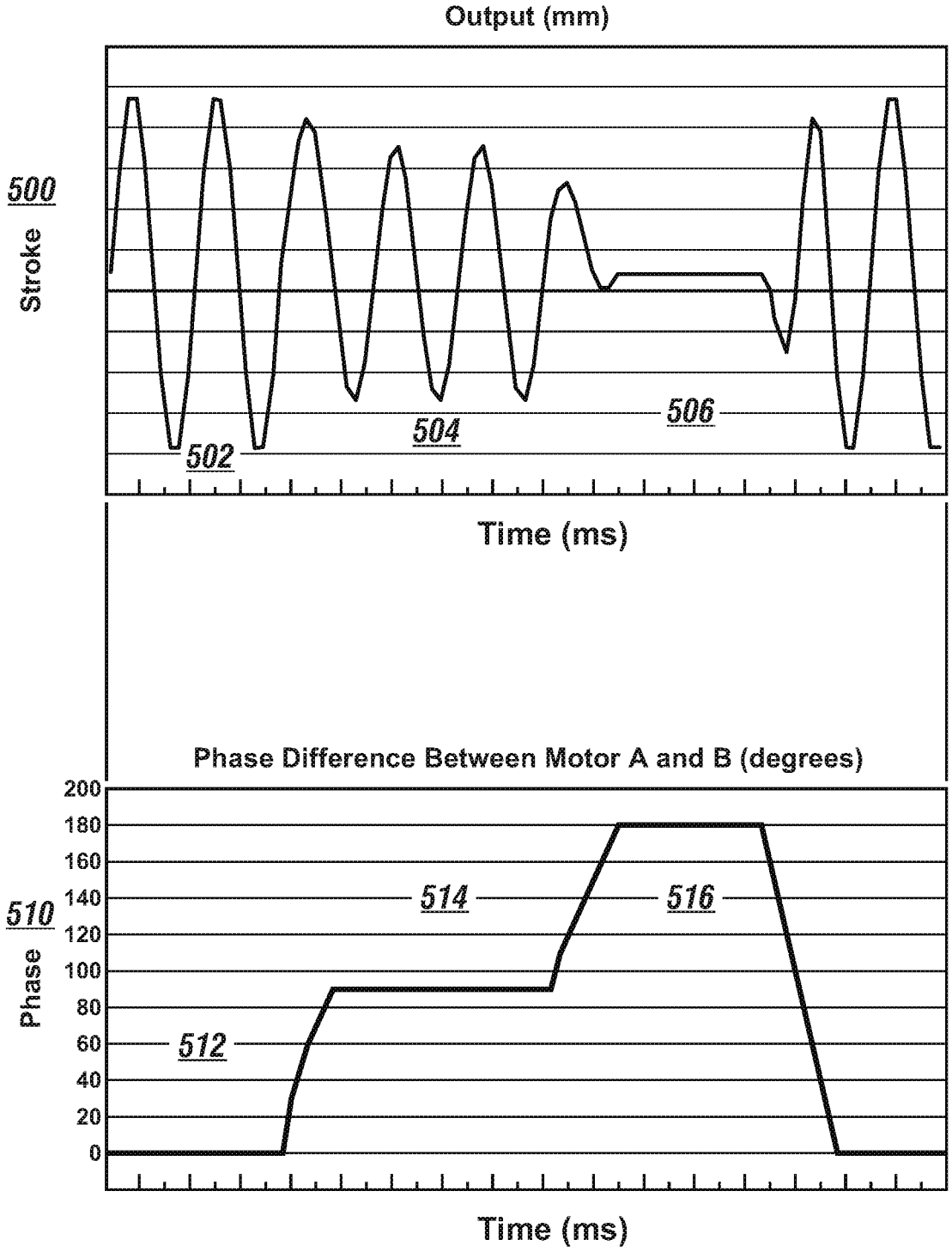
FIG. 5 graphically shows results associated with operation of an embodiment of the press described herein, including a magnitude of stroke length in relation to a phase angle between an eccentric shaft and an eccentric sleeve over a plurality of rotational cycles, in accordance with the disclosure.

FIG. 5 graphically shows operation of an embodiment of the reciprocating press 100 described herein, including a magnitude of stroke length 500 of the piston 61 of the crank-slider mechanism 60 in relation to a phase angle 510 between the eccentric shaft 20 and the rotatable eccentric sleeve 40, all in relation to time, which is indicated on the horizontal axis. As shown, at a phase angle of 0 degrees 512, the stroke length 502 is at a maximum value, and at a phase angle of 180 degrees 516, the stroke length 506 is at a minimum value. At an intermediate phase angle, e.g., at 90 degrees 514 as shown, the stroke length 504 is an intermediate value between the maximum stroke length 502 and the minimum stroke length 506. Such information can be developed and employed to calibrate an embodiment of the reciprocating press 100 for controlled operation.

Figure 6:
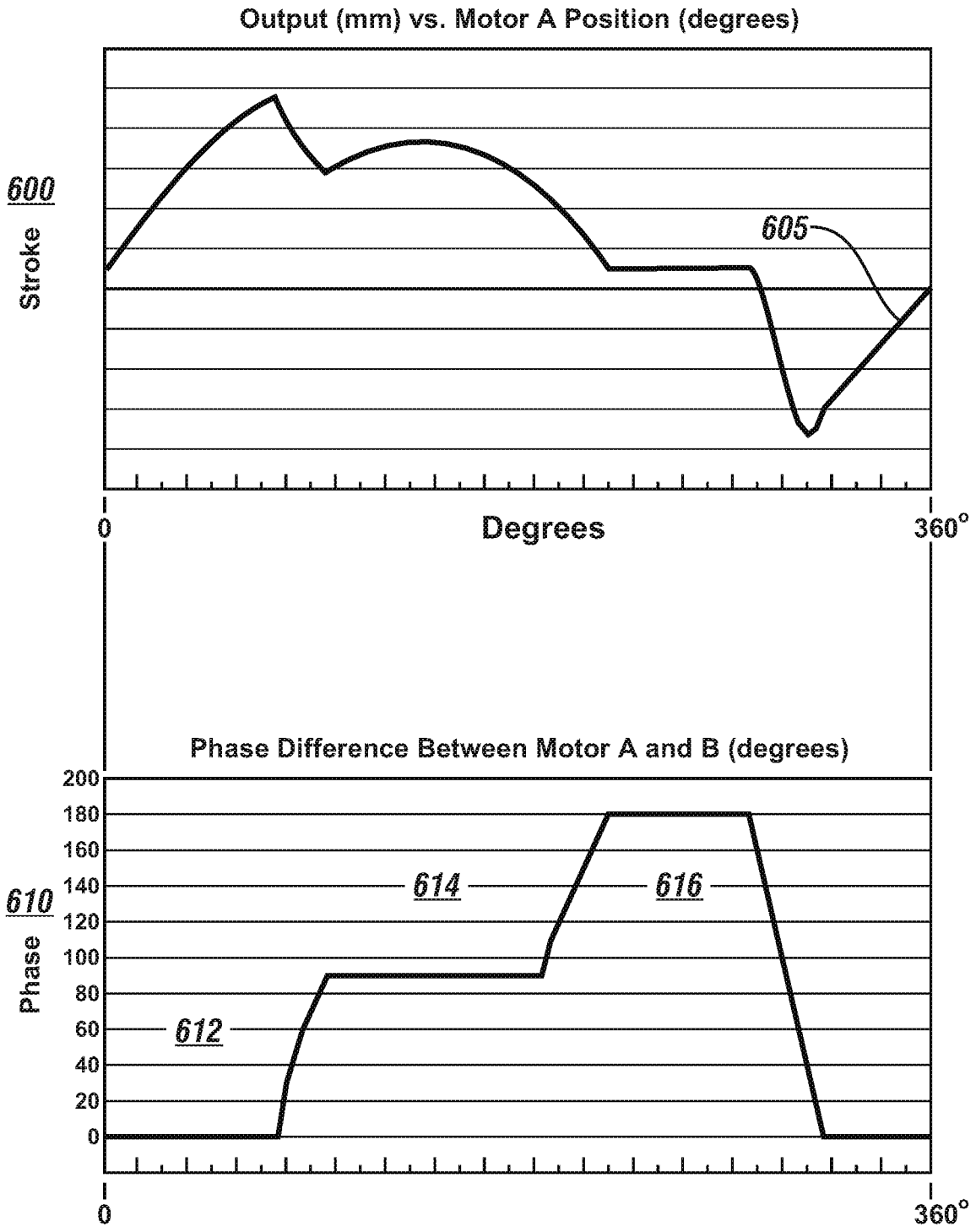
FIG. 6 graphically shows results associated with operation of an embodiment of the reciprocating press described herein, including a desired motion profile composed of a magnitude of stroke length over a single rotational cycle, in accordance with the disclosure.

FIG. 6 graphically shows results associated with operation of an embodiment of the reciprocating press described herein to illustrate the concepts described herein. These results include a motion profile 600 that is composed of a magnitude of stroke length 605 over a single rotational cycle that is achieved by varying the rotational speeds of the eccentric shaft 20 and the eccentric sleeve 40 and also varying the phase angle 610 between the eccentric shaft 20 and the eccentric sleeve 40. The phase angles include 0 degrees 612, 90 degrees 614, and 180 degrees 616. Such information can be developed and employed to calibrate an embodiment of the reciprocating press 100 for controlled operation, which includes controlling the first and second electric motors 80, 82 to control rotations of the eccentric shaft 20 and the eccentric sleeve 40, respectively, to achieve a desired motion profile, e.g., motion profile 600.

The reciprocating press 100 provides an output that is controllable to achieve a desired motion profile for use in a high speed, cyclical production environment. The reciprocating press 100 outputs linear motion via the reciprocating piston 61, and measures magnitude of force that is exerted by the piston 61 via the load cell 16. In one embodiment, the reciprocating press 100 can generate reciprocating linear motion that follows a cyclic motion profile at a rate of 10 Hz. The cyclic motion profile may be CNC-programmable. The cyclic motion profile may be dynamically changed by controlling operation of the first and second electric motors 80, 82, and thus manual adjustment may be avoided. The cyclic motion profile can be changed and redefined between batches of workpieces, during product changeovers to different workpieces, and whenever otherwise desired. The reciprocating press 100 can be employed in manufacturing environments such as for punching, stamping, drawing, press-fit assembly, eccentric motion assembly. The reciprocating press 100 can be employed in testing environments, such as for durability testing or fatigue testing.

The term "controller" and related terms such as control module, module, control, control unit, processor and similar terms refer to one or various combinations of Application Specific Integrated Circuit(s) (ASIC), System on a Chip (SOC), System on a Module (SOM), Field-Programmable Gate Arrays (FPGAs), electronic circuit(s), central processing unit(s), e.g., microprocessor(s) and associated non-transitory memory component(s) in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning and buffer circuitry and other components that can be accessed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms and similar terms mean controller-executable instruction sets including calibrations and look-up tables. Each controller executes control routine(s) to provide desired functions. Routines may be executed at regular intervals, for example each 100 microseconds during ongoing operation. Alternatively, routines may be executed in response to occurrence of a triggering event. Communication between controllers, and communication between controllers, actuators and/or sensors may be accomplished using a direct wired point-to-point link, a networked communication bus link, a wireless link or another suitable communication link, all of which are indicated by element 55. Communication includes exchanging data signals in suitable form, including, for example, electrical signals via a conductive medium, electromagnetic signals via air, optical signals via optical waveguides, and the like. The data signals may include discrete, analog or digitized analog signals representing inputs from sensors, actuator commands, elapsed time or triggering events, and communication between controllers. The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium.

The terms "calibration", "calibrate", and related terms refer to a result or a process that compares an actual or standard measurement associated with a device with a perceived or observed measurement, or a commanded position. A calibration as described herein can be reduced to a storable parametric table, a plurality of executable equations or another suitable form. A parameter is defined as a measurable quantity that represents a physical property of a device or another element that is discernible using one or more sensors and/or a physical model. A parameter may have a discrete value, e.g., either "1" or "0", or may be infinitely variable in value.

Figure 7:
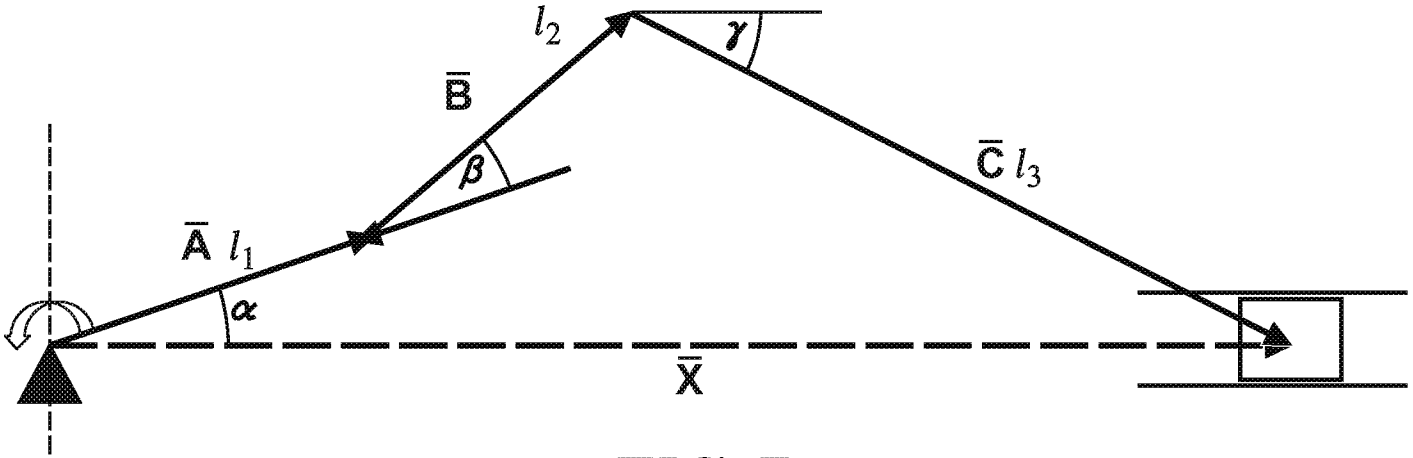
FIGS. 7 and 8 schematically show vector representations of an embodiment of the reciprocating press that can be employed to determine a stroke length and a phase angle adjustment based upon controllable operating characteristics, in accordance with the disclosure.
Figure 8:
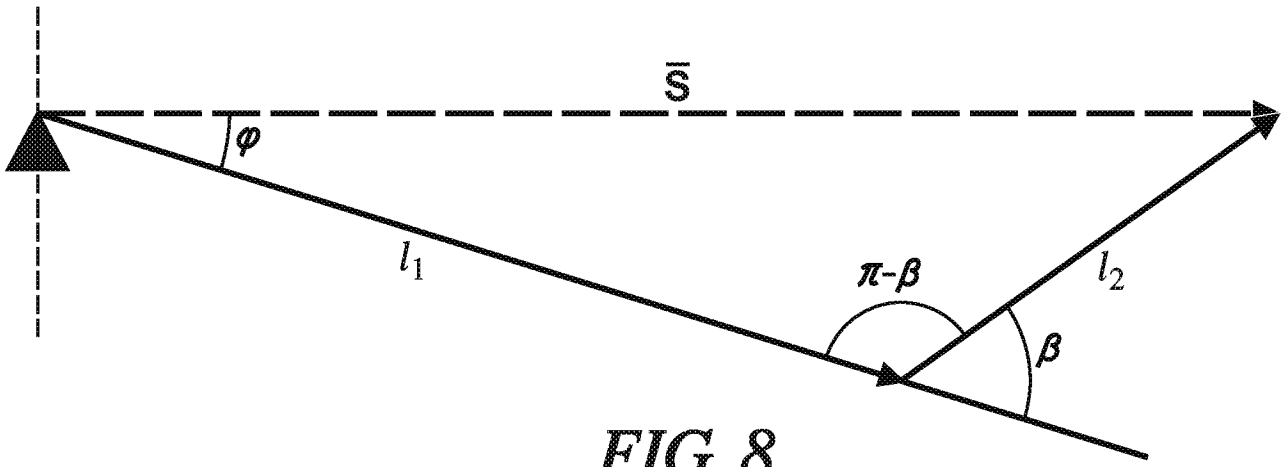

FIGS. 7 and 8 schematically show vector representations of an embodiment of the reciprocating press 100 that is shown with reference to FIGS. 1-5, which can be employed to determine a stroke length and phase angle adjustment based upon controllable operating characteristics, including angular speed and phase. Relevant terms include as follows in Table 1.

TABLE 1

| Label | Description |
|---|---|
| $l_1$ | Length of eccentric shaft offset |
| $l_2$ | Length of eccentric sleeve offset |
| $l_3$ | Length of connecting rod |
| $\overline{X}$ | Vector representation of slider position |
| $\overline{A}$ | Vector representation of eccentric shaft |
| $\overline{B}$ | Vector representation of eccentric sleeve |
| $\overline{C}$ | Vector representation of connecting rod |
| $\alpha$ | Angle of eccentric shaft |
| $\beta$ | Angle of eccentric sleeve relative to eccentric shaft (Phase angle) |
| $\gamma$ | Angle of connecting rod |
| $\varphi$ | Phase angle of system relative to eccentric shaft |
| x | Distance from center rotation point to slider pivot |
| $\omega$ | Rotational velocity of crankpin |
| S | Resultant crank radius (stroke, or Suva factor) |

The vector equation for determining the slider position X is as follows:

$$\overline{X}=\overline{A}+\overline{B}+\overline{C}$$

wherein:

$\overline{X}=(xi, 0j)$ $\overline{A}=l_1(\cos(\alpha)\ i, \sin(\alpha)j)$ $\overline{B}=l_2(\cos(\alpha+\beta)i, \sin(\alpha+\beta)j)$ $\overline{C}=l_3(\cos(\gamma)\ i, \sin(\gamma)j)$ Axis i may be defined as follows:

$$x=l_1\cos(\alpha)+l_2\cos(\alpha+\beta)+l_3\cos(\gamma)$$

Axis j may be defined as follows:

$$0 = l_1 \sin(\alpha) + l_2 \sin(\alpha+\beta) + l_3 \sin(\gamma)$$

$$\text{Assuming } l_1 \sin(\alpha) + l_2 \sin(\alpha+\beta) = k$$

$$\frac{k}{-l_3} = \sin(\gamma)$$

$$\gamma = \sin^{-1}\left(\frac{k}{-l_3}\right)$$

Employing substitution:

$$x = l_1 \cos(\alpha) + l_2 \cos(\alpha+\beta) + l_3 \cos\left(\sin^{-1}\left(\frac{k}{-l_3}\right)\right)$$

$$x = l_1 \cos(\alpha) + l_2 \cos(\alpha+\beta) + l_3 \cos\left(\sin^{-1}\left(\frac{l_1 \sin(\alpha) + l_2 \sin(\alpha+\beta)}{-l_3}\right)\right)$$

The following design criteria may be employed, and reflect an embodiment of the reciprocating press 100:

$$l_3 > l_1 + l_2 \ \& \ S \leq l_1 + l_2$$

The stroke (S) and phase angle adjustment (φ) can be determined as follows:

Cosine Rule:

$$\cos(\pi-\beta) = \frac{l_1^2 + l_2^2 - S^2}{2 l_1 l_2}$$

$$\beta = \cos^{-1}\left(\frac{S^2 - l_1^2 - l_2^2}{2 l_1 l_2}\right)$$

Sine Rule:

$$\frac{\sin(\pi-\beta)}{S} = \frac{\sin\varphi}{l_2}$$

$$\varphi(\text{rad}) = \sin^{-1}\left(\frac{l_2}{S} * \sin(\pi-\beta)\right)$$

$$\varphi^o = \sin^{-1}\left(\frac{l_2}{S} * \sin(180-\beta)\right)$$

A magnitude of the crank-slider position x can be determined as follows:

$$x = S * \cos(\alpha+\varphi) + \sqrt{l_3^2 - S^2 \sin^2(\alpha+\varphi)}$$

A magnitude of the crank-slider velocity V can be determined as follows:

$$V = \omega\left(-S * \sin(\alpha+\varphi) - \frac{S^2 \sin(\alpha+\varphi)\cos(\alpha+\varphi)}{\sqrt{l_3^2 - S^2 \sin^2(\alpha+\varphi)}}\right)$$

A magnitude of crank-slider acceleration A can be determined as follows:

$$A = \omega^2\left(-S * \cos(\alpha+\varphi) - \frac{S^2(\cos^2(\alpha+\varphi) - \sin^2(\alpha+\varphi))}{\sqrt{l_3^2 - S^2 \sin^2(\alpha+\varphi)}} - \frac{S^4 \sin^2(\alpha+\varphi)\cos^2(\alpha+\varphi)}{\left(\sqrt{l_3^2 - S^2 \cos^2(\alpha+\varphi)}\right)^3}\right)$$

The foregoing equations can be implemented as a set of calculation rules in an algorithm, and the algorithm may be executed in the controller 15 to dynamically determine the crank-slider position x, velocity V, and acceleration A, all of which can be employed to control the first and second electric motors 80, 82 to achieve a time-based control of the stroke length S of the piston 61 of the crank-slider mechanism 60 by controlling the phase angle β between the eccentric shaft 20 and the rotatable eccentric sleeve 40.

As such, the foregoing equations can be executed to determine control commands that can be executed by the controller 15 to control the first and second electric motors 80, 82 to dynamically control rotational speeds and relative phases of the eccentric shaft 20 and the rotatable eccentric sleeve 40 to achieve a desired motion profile for the piston 61, which acts upon the workpiece 99.

The following Clauses provide example configurations of a unitary reciprocating press module, as disclosed herein.

Clause 1: A reciprocating press for acting on a workpiece, comprising: an eccentric shaft rotatably disposed in a rotatable eccentric sleeve; and a crank-slider mechanism coupled to the eccentric shaft; wherein rotations of the eccentric shaft and the rotatable eccentric sleeve are independently controllable to dynamically vary a stroke length of the crank-slider mechanism.

Clause 2. The reciprocating press of clause 1: wherein the crank-slider mechanism includes a piston coupled to a connecting rod; wherein the eccentric shaft includes a crankpin; and wherein the crankpin is coupled to the connecting rod.

Clause 3. The reciprocating press of clause 2, wherein rotations of the eccentric shaft and the rotatable eccentric sleeve are independently controllable to dynamically vary a stroke length of the piston of the crank-slider mechanism.

Clause 4. The reciprocating press of clause 2, wherein rotations of the eccentric shaft and the rotatable eccentric sleeve are independently controllable to achieve a desired motion profile for the piston of the crank-slider mechanism.

Clause 5. The reciprocating press of clause 3, wherein the stroke length of the piston of the crank-slider mechanism is infinitely variable between a minimum stroke and a maximum stroke.

Clause 6. The reciprocating press of clause 2, wherein the piston of the crank-slider mechanism is arranged to reciprocate by the rotations of the eccentric shaft and the rotatable eccentric sleeve.

Clause 7. The reciprocating press of clause 2, further comprising a load sensor arranged to monitor a load exerted by the piston on the workpiece.

Clause 8. The reciprocating press of clause 2, further comprising a load sensor arranged to monitor a reaction force to a load exerted by the piston on the workpiece.

Clause 9. The reciprocating press of clause 1, wherein the rotations of the eccentric shaft and the rotatable eccentric sleeve being independently controllable to dynamically vary the stroke length of the crank-slider mechanism comprises an angular velocity of the eccentric shaft being controlled to be equivalent to an angular velocity of the rotatable eccentric sleeve, wherein the stroke length of the crank-slider mechanism is dynamically varied by adjusting a phase between an angular position of the eccentric shaft and an angular position of the rotatable eccentric sleeve.

Clause 10. The reciprocating press of clause 1, wherein the rotations of the eccentric shaft and the rotatable eccentric sleeve being independently controllable to dynamically vary the stroke length of the crank-slider mechanism comprises an angular velocity of the eccentric shaft being variable relative to an angular velocity of the rotatable eccentric sleeve, wherein the stroke length of the crank-slider mechanism is dynamically varied by adjusting a phase between an angular position of the eccentric shaft and an angular position of the rotatable eccentric sleeve in response to a desired motion profile.

Clause 11. The reciprocating press of clause 1, further comprising a first electric motor coupled to the eccentric shaft; and a second electric motor coupled to the rotatable eccentric sleeve; wherein the first and second electric motors are independently and dynamically controllable to control the rotations of the eccentric shaft and the rotatable eccentric sleeve to control the stroke length of the crank-slider mechanism.

Clause 12. The reciprocating press of clause 11, further comprising a controller in communication with the first and second electric motors, wherein the controller controls the first and second electric motors to control the rotations of the eccentric shaft and the rotatable eccentric sleeve to control the stroke length of the crank-slider mechanism.

Clause 13. The reciprocating press of clause 11, further comprising a harmonic gearset, wherein the eccentric shaft is coupled to the first motor via the harmonic gearset.

Clause 14. The reciprocating press of clause 11, further comprising an offset belt driver, wherein the rotatable eccentric sleeve is coupled to the second motor via the offset belt driver.

Clause 15. The reciprocating press of clause 11, wherein the eccentric shaft includes an upper portion, a middle portion and a lower portion; wherein the upper portion of the eccentric shaft is coupled to the first motor via an offset coupler and a harmonic gearset; wherein the middle portion of the eccentric shaft is arranged to rotate within the inner portion of the rotatable eccentric sleeve; and wherein a crankpin is disposed on the lower portion.

Clause 16. The reciprocating press of clause 11, wherein the offset coupler comprises a Schmidt coupler.

Clause 17. The reciprocating press of clause 11, further comprising: wherein the first electric motor includes a rotor that defines a first axis; wherein the eccentric shaft defines a second axis; and wherein the first axis is parallel to and offset from the second axis.

Clause 18. The device of clause 1, further comprising a dynamic counterbalance element disposed on the rotatable eccentric sleeve.

Clause 19. A reciprocating press for acting on a workpiece, comprising an eccentric shaft rotatably disposed in a rotatable eccentric sleeve; a crank-slider mechanism coupled to the eccentric shaft; a first electric motor operably coupled to the eccentric shaft; and a second electric motor operably coupled to the rotatable eccentric sleeve; wherein the first and second electric motors are independently controllable to control rotations of the eccentric shaft and the rotatable eccentric sleeve to dynamically vary a reciprocating stroke length of the crank-slider mechanism.

Clause 20. The reciprocating press of clause 15, wherein the crank-slider mechanism includes a piston disposed to act on the workpiece.

Clause 21. The reciprocating press of clause 19, wherein the first and second electric motors being independently controlled to control rotations of the eccentric shaft and the rotational eccentric sleeve comprise the first and second electric motors being independently controlled to control phase of rotation of the eccentric shaft relative to a rotation of the eccentric sleeve.

Clause 22. The reciprocating press of clause 19, wherein the first and second electric motors being independently controlled to control rotations of the eccentric shaft and the rotational eccentric sleeve comprise the first and second electric motors being independently controlled to rotations of the eccentric shaft and the eccentric sleeve in response to a desired motion profile.

Clause 23. The reciprocating press of clause 19, further comprising a load sensor, the load sensor being arranged to monitor a load exerted by the piston on the workpiece and being arranged to monitor a reaction force to a load exerted by the piston on the workpiece.

Clause 24. The reciprocating press of clause 23, further comprising a controller in communication with the first and second electric motors, wherein the controller is arranged to control rotations of the first and second electric motors in response to a desired motion profile.

Clause 25. The reciprocating press of clause 24, wherein the controller is arranged to control rotations of the first and second electric motors in response to a desired motion profile comprises the controller arranged to control rotational speeds and relative phases of the first and second electric motors in response to the desired motion profile.

Clause 26. A device for exerting a reciprocating force on a workpiece, comprising: an eccentric shaft, an eccentric sleeve, a crank-slider mechanism, a first electric motor, a second electric motor, a housing portion, a base portion, and a mount portion; the eccentric shaft being rotatably disposed within the rotatable eccentric sleeve, and the rotatable eccentric sleeve being rotatably disposed in the housing portion; the eccentric shaft including a crankpin; the eccentric shaft rotatably coupled to the first motor; the rotatable eccentric sleeve rotatably coupled to the second motor; the crank-slider mechanism including a piston and a connecting rod; the piston of the crank-slider mechanism being disposed in and translatable in the mount portion; the crankpin being disposed in the base portion; and the connecting rod of the crank-slider mechanism being coupled to the crankpin; wherein the piston is disposed to act upon a workpiece that is disposed adjacent to the mount portion; wherein the piston of crank-slider mechanism is arranged to reciprocate in the mount portion by rotations of the eccentric shaft and the rotatable eccentric sleeve; and wherein the first and second electric motors are independently controllable to control rotations of the eccentric shaft and the rotatable eccentric sleeve to dynamically vary a stroke length of the reciprocating piston.

Clause 27. The device of clause 26, wherein a magnitude of stroke length is determined based upon a rotational phase difference between the eccentric shaft and the rotatable eccentric sleeve.

Clause 28. The device of clause 27, further comprising: a controller operatively coupled to the first and second electric motors; wherein the first and second electric motors are controllable by the controller to control the piston at a dynamically variable stroke length to act upon the workpiece via the eccentric shaft and the rotatable eccentric sleeve.

Clause 29. The device of clause 28, wherein the first and second electric motors being controllable by the controller to control the piston at a dynamically variable stroke length to act upon the workpiece via the eccentric shaft and the rotatable eccentric sleeve comprises the first and second electric motors being controllable by the controller to control the piston responsive to a desired motion profile.

Clause 30. A method for controlling a reciprocating press, the reciprocating press including an eccentric shaft rotatably disposed in a rotatable eccentric sleeve, a crank-slider mechanism coupled to the eccentric shaft, a first electric motor operably coupled to the eccentric shaft, and a second electric motor operably coupled to the rotatable eccentric sleeve, the method comprising: controlling an angular position of the first electric motor and controlling an angular position of the second electric motor; and dynamically controlling a stroke of a piston of the crank-slider mechanism based upon the angular positions of the first and second electric motors.

Clause 31. The method of clause 30, further comprising: determining a desired motion profile for the stroke of the piston; and controlling the angular position of the first electric motor and controlling the angular position of the second electric motor based upon the desired motion profile for the stroke of the piston.

The concepts described herein may be advantageously employed in manufacturing assembly and/or test.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

What is claimed is:

1. A reciprocating press for acting on a workpiece, comprising:

an eccentric shaft rotatably disposed in a rotatable eccentric sleeve; and a crank-slider mechanism coupled to the eccentric shaft;

a first electric motor coupled to the eccentric shaft and a second electric motor coupled to the rotatable eccentric sleeve;

wherein the first and second electric motors are independently and dynamically controllable to control rotations of the eccentric shaft and the rotatable eccentric sleeve to control a stroke length of the crank-slider mechanism;

wherein an upper portion of the eccentric shaft is coupled to the first electric motor via an offset coupler and a harmonic gearset;

wherein a middle portion of the eccentric shaft is arranged to rotate within an inner portion of the rotatable eccentric sleeve;

wherein a crankpin is disposed on a lower portion of the eccentric shaft; and wherein the rotations of the eccentric shaft and the rotatable eccentric sleeve are independently controllable to dynamically vary the stroke length of the crank-slider mechanism.

2. The reciprocating press of claim 1:

wherein the crank-slider mechanism includes a piston coupled to a connecting rod; and wherein the crankpin is coupled to the connecting rod.

3. The reciprocating press of claim 2, wherein rotations of the eccentric shaft and the rotatable eccentric sleeve are independently controllable to dynamically vary the stroke length of the piston of the crank-slider mechanism.

4. The reciprocating press of claim 2, wherein rotations of the eccentric shaft and the rotatable eccentric sleeve are independently controllable to achieve a motion profile for the piston of the crank-slider mechanism, wherein the motion profile is composed of a plurality of stroke lengths over a single rotational cycle that is achieved by varying the rotational speeds of the eccentric shaft and the eccentric sleeve, and varying a phase angle between the eccentric shaft and the eccentric sleeve.

5. The reciprocating press of claim 3, wherein the stroke length of the piston of the crank-slider mechanism is infinitely variable between a minimum stroke and a maximum stroke.

6. The reciprocating press of claim 2, wherein the piston of the crank-slider mechanism is arranged to reciprocate by the rotations of the eccentric shaft and the rotatable eccentric sleeve.

7. The reciprocating press of claim 2, further comprising a load sensor arranged to monitor a load exerted by the piston on the workpiece.

8. The reciprocating press of claim 2, further comprising a load sensor arranged to monitor a reaction force to a load exerted by the piston on the workpiece.

9. The reciprocating press of claim 1, wherein the rotations of the eccentric shaft and the rotatable eccentric sleeve being independently controllable to dynamically vary the stroke length of the crank-slider mechanism comprises:

an angular velocity of the eccentric shaft being controlled to be equivalent to an angular velocity of the rotatable eccentric sleeve, wherein the stroke length of the crank-slider mechanism is dynamically varied by adjusting a phase between an angular position of the eccentric shaft and an angular position of the rotatable eccentric sleeve.

10. The reciprocating press of claim 1, wherein the rotations of the eccentric shaft and the rotatable eccentric sleeve being independently controllable to dynamically vary the stroke length of the crank-slider mechanism comprises:

an angular velocity of the eccentric shaft being variable relative to an angular velocity of the rotatable eccentric sleeve, wherein the stroke length of the crank-slider mechanism is dynamically varied by adjusting a phase between an angular position of the eccentric shaft and an angular position of the rotatable eccentric sleeve in response to a motion profile.

11. The reciprocating press of claim 1, further comprising a controller in communication with the first and second electric motors, wherein the controller controls the first and second electric motors to control the rotations of the eccentric shaft and the rotatable eccentric sleeve to control the stroke length of the crank-slider mechanism.

12. The reciprocating press of claim 1, further comprising an offset belt driver, wherein the rotatable eccentric sleeve is coupled to the second electric motor via the offset belt driver.

13. The reciprocating press of claim 1, wherein the first electric motor includes a rotor that defines a first axis;

wherein the eccentric shaft defines a second axis; and wherein the first axis is parallel to and offset from the second axis.

14. The reciprocating press of claim 1, further comprising a counterweight dynamic counterbalance element disposed on the rotatable eccentric sleeve.

15. A reciprocating press for acting on a workpiece, comprising:

an eccentric shaft rotatably disposed in a rotatable eccentric sleeve;

a crank-slider mechanism coupled to the eccentric shaft;

a first electric motor operably coupled to the eccentric shaft; and a second electric motor operably coupled to the rotatable eccentric sleeve;

wherein the first and second electric motors are independently controllable to control rotations of the eccentric shaft and the rotatable eccentric sleeve to dynamically vary a reciprocating stroke length of the crank-slider mechanism;

wherein an upper portion of the eccentric shaft is coupled to the first electric motor via an offset coupler and a harmonic gearset;

wherein a middle portion of the eccentric shaft is arranged to rotate within an inner portion of the rotatable eccentric sleeve; and wherein a crankpin is disposed on a lower portion of the eccentric shaft.

16. The reciprocating press of claim 15, further comprising the crank-slider mechanism including a piston coupled to a connecting rod and disposed to act on the workpiece.

17. The reciprocating press of claim 15, wherein the first and second electric motors being independently controlled to control rotations of the eccentric shaft and the rotational eccentric sleeve comprise the first and second electric motors being independently controlled to control phase of rotation of the eccentric shaft relative to rotation of the eccentric sleeve.

18. The reciprocating press of claim 15, wherein the first and second electric motors being independently controlled to control rotations of the eccentric shaft and the rotational eccentric sleeve comprise the first and second electric motors being independently controlled to control rotations of the eccentric shaft and the eccentric sleeve in response to a motion profile, wherein the motion profile is composed of a plurality of stroke lengths over a single rotational cycle that is achieved by varying the rotational speeds of the eccentric shaft and the eccentric sleeve, and varying a phase angle between the eccentric shaft and the eccentric sleeve.

19. The reciprocating press of claim 15, further comprising a load sensor, the load sensor being arranged to monitor a load exerted by a piston of the crank-slider mechanism on the workpiece and being arranged to monitor a reaction force to the load exerted by the piston on the workpiece.

20. The reciprocating press of claim 19, further comprising a controller in communication with the first and second electric motors, wherein the controller is arranged to control rotations of the first and second electric motors in response to a desired motion profile.

21. The reciprocating press of claim 20, wherein the controller is arranged to control rotations of the first and second electric motors in response to the desired motion profile comprises the controller arranged to control rotational speeds and relative phases of the first and second electric motors in response to the motion profile.

22. A reciprocating press, comprising:

an eccentric shaft, a rotatable eccentric sleeve, a crank-slider mechanism, a first electric motor, a second electric motor, a housing portion, a base portion, and a mount portion;

the eccentric shaft being rotatably disposed within the rotatable eccentric sleeve, and the rotatable eccentric sleeve being rotatably disposed in the housing portion;

the eccentric shaft including a crankpin;

the eccentric shaft rotatably coupled to the first electric motor;

the rotatable eccentric sleeve rotatably coupled to the second electric motor;

the crank-slider mechanism including a piston and a connecting rod;

the piston of the crank-slider mechanism being disposed in and translatable in the mount portion;

the crankpin being disposed in the base portion; and the connecting rod of the crank-slider mechanism being coupled to the crankpin;

wherein the piston is arranged to act upon a workpiece that is disposed adjacent to the mount portion;

wherein the piston of the crank-slider mechanism is arranged to reciprocate in the mount portion by rotations of the eccentric shaft and the rotatable eccentric sleeve; and wherein the first and second electric motors are independently controllable to control rotations of the eccentric shaft and the rotatable eccentric sleeve to dynamically vary a stroke length of the piston;

wherein an upper portion of the eccentric shaft is coupled to the first electric motor via an offset coupler and a harmonic gearset;

wherein a middle portion of the eccentric shaft is arranged to rotate within an inner portion of the rotatable eccentric sleeve; and wherein the crankpin is disposed on a lower portion of the eccentric shaft.

23. The reciprocating press of claim 22, wherein a magnitude of the stroke length is determined based upon a rotational phase difference between the eccentric shaft and the rotatable eccentric sleeve.

24. The reciprocating press of claim 23, further comprising:

a controller operatively coupled to the first and second electric motors;

wherein the first and second electric motors are controllable by the controller to control the piston at a dynamically variable stroke length to act upon the workpiece via the eccentric shaft and the rotatable eccentric sleeve.

25. The reciprocating press of claim 24, wherein the first and second electric motors being controllable by the controller to control the piston at a dynamically variable stroke length to act upon the workpiece via the eccentric shaft and the rotatable eccentric sleeve comprises the first and second electric motors being controllable by the controller to control the piston responsive to a motion profile.

26. A method for controlling a reciprocating press, the reciprocating press including an eccentric shaft rotatably disposed in a rotatable eccentric sleeve, a crank-slider mechanism coupled to the eccentric shaft, a first electric motor operably coupled to the eccentric shaft, and a second electric motor operably coupled to the rotatable eccentric sleeve, the method comprising:

controlling an angular position of the first electric motor and controlling an angular position of the second electric motor; and dynamically controlling a stroke of a piston of the crank-slider mechanism based upon the angular positions of the first and second electric motors;

wherein the first and second electric motors are independently controllable to control the angular positions of the eccentric shaft and the rotatable eccentric sleeve to control the stroke of the piston;

wherein an upper portion of the eccentric shaft is coupled to the first electric motor via an offset coupler and a harmonic gearset;

wherein a middle portion of the eccentric shaft is arranged to rotate within an inner portion of the rotatable eccentric sleeve; and wherein a crankpin is disposed on a lower portion of the eccentric shaft.

27. The method of claim 26, further comprising:

determining a motion profile for the stroke of the piston, wherein the motion profile is composed of a plurality of stroke lengths over a single rotational cycle that is achieved by varying the rotational speeds of the eccentric shaft and the eccentric sleeve, and varying a phase angle between the eccentric shaft and the eccentric sleeve; and controlling the angular position of the first electric motor and controlling the angular position of the second electric motor based upon the motion profile for the stroke of the piston.

* * * * *